United States Patent [19]

Guiliani

[11] 3,981,388

[45] Sept. 21, 1976

[54] AUTOMATIC BOTTOM MARGIN SIGNAL SYSTEM FOR TYPEWRITERS

[76] Inventor: Robert L. Guiliani, 45310 Akimala Place, Kaneohe, Hawaii 96744

[22] Filed: Nov. 20, 1974

[21] Appl. No.: 525,593

[52] U.S. Cl. ..... 197/189

[51] Int. Cl.[2] ..... B41J 29/44

[58] Field of Search ..... 197/189, 141; 101/233, 101/234, 235

[56] References Cited

UNITED STATES PATENTS

| | | | |
|---|---|---|---|
| 1,208,606 | 12/1916 | Mayer | 197/189 |
| 2,689,033 | 9/1954 | Grenier | 197/189 |

FOREIGN PATENTS OR APPLICATIONS

| | | | |
|---|---|---|---|
| 1,812,168 | 8/1970 | Germany | 197/189 |

*Primary Examiner*—Anton O. Oechsle

*Attorney, Agent, or Firm*—Joseph E. Rusz; Henry S. Miller

[57] ABSTRACT

A device for detecting the trailing end of a sheet inserted in a typewriter including a rod adjustably mounted on the carriage, extending below the platen and a transparent table for carrying the sheet. A reflective plate is positioned above the table, and the platen has a reflective coating. The rod supports a miniature light source and photo cell so that light returned from the reflective surfaces will generate a current in the photocell causing activation of an alarm. An alternative embodiment utilizes an electrically conductive rod arrangement including contact on the typewriter frame to create a closed circuit, the sheet passes through the contact point breaking the circuit.

3 Claims, 3 Drawing Figures

FIG. 1
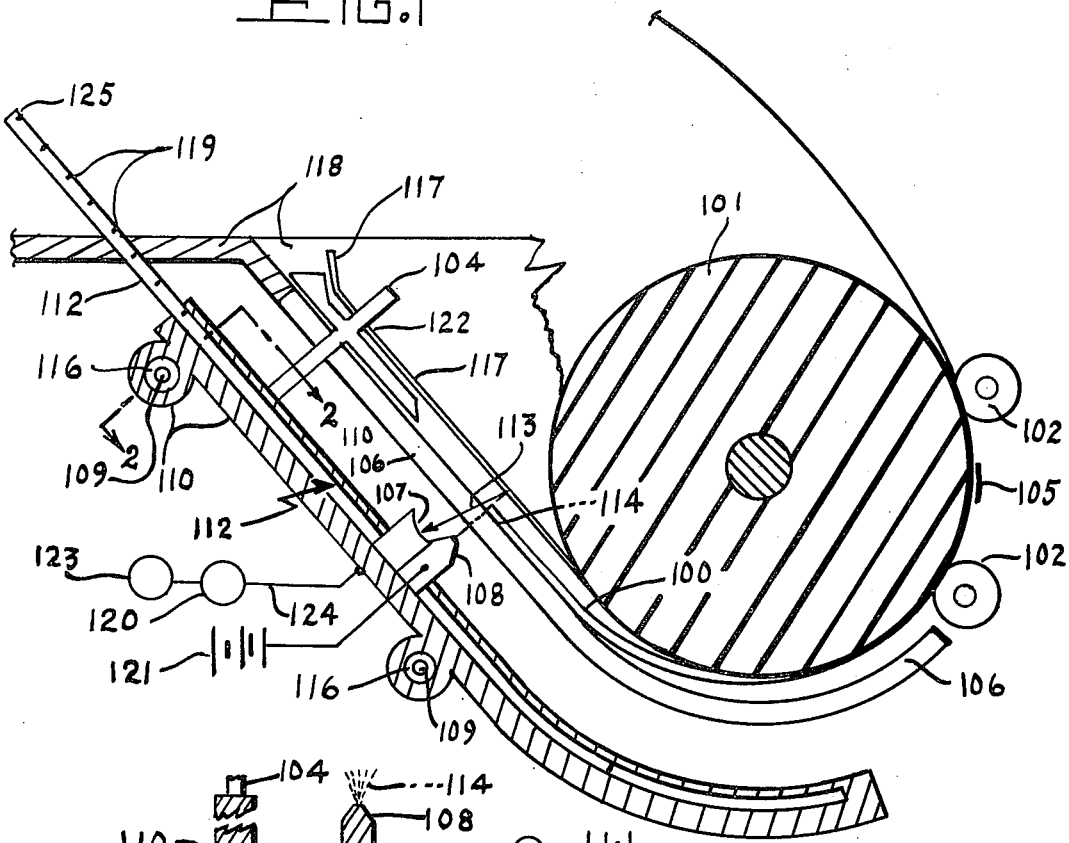
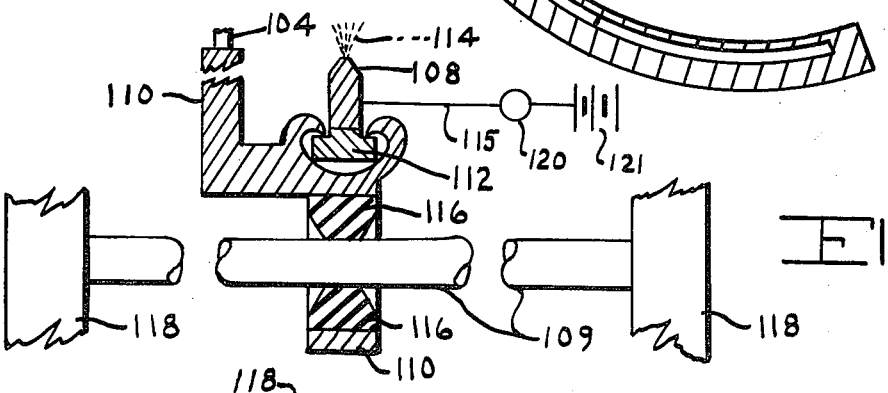
FIG. 2
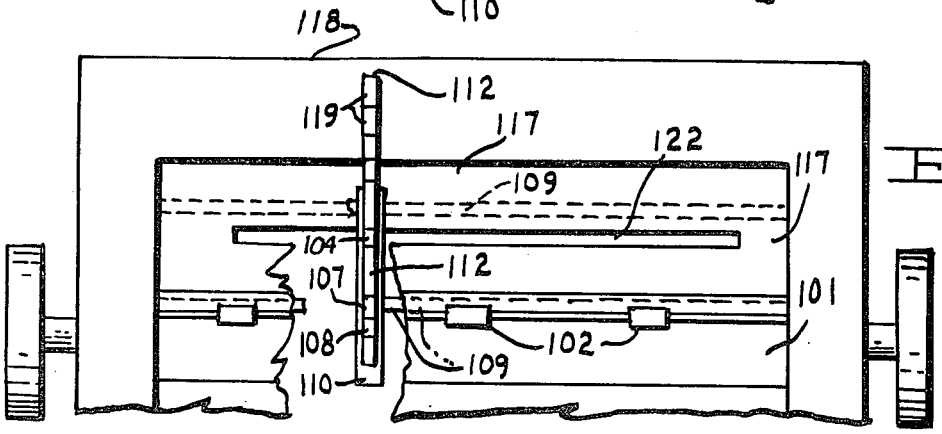
FIG. 3

AUTOMATIC BOTTOM MARGIN SIGNAL SYSTEM FOR TYPEWRITERS

Statement of Government Interest

The invention described herein may be manufactured and used by or for the Government for governmental purposes without the payment of any royalty thereon.

BACKGROUND OF THE INVENTION

This invention relates generally to a margin sensing means for printing machines and more particularly to an electronic margin sensing means for indicating the bottom margin on typewritten sheets. Although there have been a number of significant advances recently in the art of small business machines, the typewriter, with one possible exception, has remained practically unchanged for many years. Numerous gadgetry modifications have been proposed for purposes of commercial exploitation, however, the typewriter regardless of its facade, retains its basic utilitarian form.

Despite substantial interest in the typewriter art over the years, there is one aspect of typewriting that has escaped the designers and builders of these machines. This invention fills a need long felt by typists. That need is the ability to automatically set a bottom margin on the typewritten sheet. Various techniques have been taught by typing instructors to alert the typist that the paper should be changed. These include measuring from the bottom of the paper before insertion, and either marking the paper lightly with a pencil, or pinching the paper to leave a mark. While these methods solve the basic problem for the student or beginner, it becomes a chore or burden on the professional secretary who is often in a hurry, and who may type many pages each day.

This invention provides a fast automatic means for signalling the typist that the bottom margin of the page has been reached and it is not time to change paper. The system is readily adjustable in order that the margin may be changed easily by the typist, thereby conserving time and energy.

SUMMARY OF THE INVENTION

The invention includes a means for selectively setting the width of the margin at the bottom of a paper sheet in a typewriter or like device. As a result of the invention, a signal is generated for the typist indicating when the margin has been reached.

The system uses a light source and photo-electric cell mounted on a flexible, movable measuring rod having measurement marks on its upper end for setting a desired width of the bottom margin. The paper is supported and guided around the platen between a clear, transparent paper table, and a reflecting surface member, which is preferably a one-way mirror type, adjacent the circular typewriter platen which would also have a light reflecting surface. As the bottom edge of the paper reaches a preselected point, the light beam, normally blocked from the reflecting surface by the paper, is reflected back on the photo-electric cell to close a circuit which provides a signal notifying the typist that the desired preselected bottom margin has been reached.

In an alternative embodiment, the measuring rod includes an electrically conductive means which is normally in a biased contact with the frame of the typewriter, completing an electrical circuit. As the sheet is inserted into the typewriter, it passes between the conductive means and the frame, breaking the electrical circuit. The circuit is again closed after the paper passes the contact point. By adjusting the measuring rod, it is possible to control where contact will be made with the frame, the circuit closed, and a signal generated for the typist.

It is therefore an object of the invention to provide a new and improved, automatic bottom margin signal system for typewriters.

It is another object of the invention to provide a new and improved margin signal system for a typewriter that is accurately adjustable.

It is a further object of the invention to provide a new and improved margin signal system for typewriters that is reliable and functions equally as well with all size sheets.

It is still another object of the invention to provide a new and improved margin signal system for typewriters that is adaptable to a variety of makes of typewriters without modification.

It is still a further object of the invention to provide a new and improved margin signal system for typewriters that will automatically warn the operator when the last line of the sheet has been reached.

It is another object of the invention to provide a new and improved margin signal system for typewriters that will allow the operator to concentrate on the task to be performed without typing into the margin.

It is another object of the invention to provide a new and improved margin signal system for typewriters which is economical to produce and utilizes conventional, currently available components that lend themselves to standard mass production manufacturing techniques.

These and other advantages, features and objects of the invention will become more apparent from the following description taken in connection with the illustrative embodiments in the accompanying drawings.

DESCRIPTION OF THE DRAWINGS

FIG. 1 is a cross sectional view of the invention.

FIG. 2 is a view of the invention taken along line 2—2 in FIG. 1.

FIG. 3 is a partially cutaway top view of the invention.

DESCRIPTION OF THE PREFERRED EMBODIMENTS

Referring now to FIGS. 1, 2 and 3 there is shown a cross sectional view of a typical typewriter carriage with parts of the frame cut away showing the relative position of the invention. Shown are the well known rollers 102 that retain the paper 100 in place as it progresses from line to line through the typewriter. When loading the typewriter, the paper 100 is held in the hand and placed on the clear, transparent, non-reflective paper table 106 which may be of a plastic materialand under the reflective plate 117 which may consist of a material that will perform as a one way mirror and thus causing the emitted light 114 to be reflected 113 while allowing observation of the paper 100 from the top. A light source 108 and a photoelectric light sensor 107 which acts as an electric eye are firmly attached to a slightly flexible measuring rod 112. The measuring rod 112 is shiftable along a fixed path formed by the rod guide 110. FIG. 2 shows that the points of contact between the rod guide 110 and the measuring rod 112 may be limited. This is to reduce the friction between these two components while firmly holding the measuring rod 112 in its intended path as it is manually adjusted to measure the correct margin width along the paper 100 from a point indicated by the typewriter ribbon 105 to the path of the emitted light 114. If the width of the margin is to be changed, then the measuring rod 112 is manually adjusted at point 125 causing the electric eye assembly 107 and 108 to move, thus changing the distance between the typewriter ribbon 105 and the light emitter 108. The connecting conductor 115 transfers power from the source 121 to the light emitter 108. The light emitter 108 will illuminate the non-reflective paper 100 as the paper progresses, line by line, around the light reflecting platen 101 until the bottom edge of the paper 100 passes the light path 114. When this occurs, the emitted light will be reflected 113 from the plate 117, or from the light reflecting platen 101 at point A, for instance, and sensed by the photoelectric cell 107. The subsequent electric charge will be transferred over the connecting conductor 124 to the switch 120. This charge causes the switch 120 to be reactivated and thereby activating the alarm 123. The activation of the alarm 123 notifies the typist that the last typing line of the page 100 has been reached, and the completed typewritten page 100 is ready to be removed. The switch 120 is automatically reset when another page is inserted and prevents light from reflecting to the light sensor 107. The paper edge guide 104 protrudes through a horizontal slot 122 in the reflective plate 117 and this permits lateral adjustment of the paper in the well known manner. The guide 104 is widened between the reflective plate 117 and the paper table 106 to the width normally required to guide the paper 100 edge.

Concerning FIG. 2, the guide 104 is securely attached to the guide rod 110. The guide rod 110 slides horizontally on parallel rods 109, whose end points are anchored to the typewriter frame 118. The bushings 116 are made of a low friction material and beveled to permit the guide rod 110 and the attached paper guide 104 to move horizontally along the typewriter carriage by easily pushing upon the paper guide 104.

The measuring stick as shown in FIG. 3 marks 119 which may be visually aligned with the top of the frame 118 thus causing the electric eye mechanism 107 and 108 to be properly placed an equal distance from the typewriter ribbon 105 as measured along the paper 100 around the platen 101.

By permitting horizontal movement of the electric eye assembly 107 and 108 along rods 109 and simultaneous vertical movement back and forth along the measuring rod 112, the electric eye assembly 107 and 108 can be placed at any chosen point on the paper table 106. This ability accommodates paper 100 of any size.

It was mentioned that the platen 101 may have a reflective surface such as an adequate covering or paint that will not interfere with the normal function of the platen but will allow the narrowest margin desired by permitting the electric eye assembly 107 and 108 to be positioned at point A which is beyond the leading edge of the reflective plate 117.

The purpose of the reflective plate 117 is to reflect the light 114 along path 113 to the sensor 107. This plate may be attached to the typewriter frame 118 so that it is easily removed for cleaning of the transparent paper table 106.

Although the invention has been described with reference to a particular embodiment, it will be understood to those skilled in the art that the invention is capable of a variety of alternative embodiments within the spirit and scope of the appended claims.

What is claimed is:

1. Automatic bottom margin signal system for typewriters comprising: a typewriting means; transparent means located on the typewriting means for receiving material in sheets adopted to be used in said typewriting means; a light reflective plate means positioned in a parallel plane on one side of and spaced from the transparent means with the sheet material receivable therebetween; a slightly flexible rod means adjustably mounted on the typewriting means on the otherside of said transparent means in a plane parallel thereto and spaced therefrom; a light source mounted on the rod means; a light responsive means mounted on the rod means in juxtaposition with the light source, whereby light from the source will shine through the transparent means to the reflective plate means and reflect back to the light responsive means; alarm means, and electrical circuit means connected between the light responsive means and alarm means whereby light from the light source being unobstructed by the sheet material and reflected from the reflective plate reaching the light responsive means will cause the alarm to be activated.

2. An automatic bottom margin signal system for typewriters according to claim 1 wherein the light responsive means is a photo cell.

3. An automatic bottom margin signal system for typewriters according to claim 2 wherein the alarm means is a bell.

* * * * *

UNITED STATES PATENT OFFICE

CERTIFICATE OF CORRECTION

PATENT NO. : 3,981,388

DATED : Sept. 21, 1976

INVENTOR(S) : Robert L. Giuliani

It is certified that error appears in the above-identified patent and that said Letters Patent are hereby corrected as shown below:

Cover sheet, under "United States Patent /19/" change "Guiliani" to -- Giuliani --.

Cover sheet, after "/76/ Inventor:" change "Robert L. Guiliani" to -- Robert L. Giuliani --.

Signed and Sealed this

Twenty-first Day of December 1976

[SEAL]

*Attest:*

RUTH C. MASON
*Attesting Officer*

C. MARSHALL DANN
*Commissioner of Patents and Trademarks*